US005203300A

United States Patent [19]

Orzel

[11] Patent Number: 5,203,300

[45] Date of Patent: Apr. 20, 1993

[54] IDLE SPEED CONTROL SYSTEM

[75] Inventor: Daniel V. Orzel, Westland, Mich.

[73] Assignee: Ford Motor Company, Dearborn, Mich.

[21] Appl. No.: 967,884

[22] Filed: Oct. 28, 1992

[51] Int. Cl.[5] ..... F02M 3/00

[52] U.S. Cl. ..... 123/339; 123/520

[58] Field of Search ..... 123/339, 520, 672, 518, 123/406; 73/178.1

[56] References Cited

U.S. PATENT DOCUMENTS

| | | | |
|---|---|---|---|
| 4,345,557 | 8/1982 | Ikeura | 123/339 |
| 4,467,769 | 8/1984 | Matsumura | 123/672 |
| 4,483,186 | 11/1984 | Parol | 73/118.1 |
| 4,619,232 | 10/1986 | Morris | 123/339 |
| 4,641,623 | 2/1987 | Hamburg | 123/518 |
| 4,715,340 | 12/1987 | Cook et al. | 123/406 |
| 4,741,318 | 5/1988 | Kortge et al. | 123/520 |
| 4,967,713 | 11/1990 | Kojima | 123/520 |
| 4,974,444 | 12/1990 | Neubacher | 73/118.1 |
| 5,041,976 | 8/1991 | Marko et al. | 364/424.03 |
| 5,048,492 | 9/1991 | Davenport et al. | 123/672 |
| 5,048,493 | 9/1991 | Orzel et al. | 123/672 |
| 5,083,541 | 1/1992 | Chen | 123/339 |
| 5,090,388 | 2/1992 | Hamburg et al. | 123/672 |

*Primary Examiner*—Raymond A. Nelli

*Attorney, Agent, or Firm*—Allan J. Lippa; Roger L. May

[57] ABSTRACT

A control system (10) controls both engine idle speed and purge flow through a fuel vapor recovery system (86) into an air/fuel intake of the engine. A bypass throttle valve (72) connected in parallel with a primary engine throttle (62) is controlled by a feedback variable (ISFV) related to a difference between actual idle speed and desired idle speed. Purge flow (pdc) is reduced when the bypass throttle position falls below a dead band provided stoichiometric air/fuel control is maintained.

10 Claims, 7 Drawing Sheets

IDLE SPEED CONTROL SYSTEM

BACKGROUND OF THE INVENTION

The field of the invention relates to idle speed control systems for motor vehicles having fuel vapor recovery systems coupled between the fuel system and engine air/fuel intake.

It is known to maintain idle speed of a motor vehicle at a desired idle speed by feedback control of a bypass throttling device. During idle speed control operation, purging of the fuel vapor recovery system through the engine air/fuel intake is typically disabled.

The inventor herein has recognized a need and provided a system to purge the fuel vapor recovery system during engine idle. With such a proposed system, approximately seventy-five percent (75%) of inducted air during idle may be contributed from the fuel vapor recovery system. If purging subsequently ceases during engine idle, insufficient air may be inducted to maintain engine idle during the transient response time of the feedback loop. Engine stumble or stall may therefore result.

SUMMARY OF THE INVENTION

An object of the invention herein is to control both a bypass throttle valve and fuel vapor recovery system to achieve accurate engine idle speed control.

The above object is achieved, and problems of prior approaches overcome, by providing both a control system and a control method for controlling idling speed of an engine by controlling a bypass throttle connected in parallel to a primary engine throttle and also controlling purge flow through a vapor recovery system into an air/fuel intake of the engine. In one particular aspect of the invention, the method comprises the steps of: positioning the bypass throttle to decrease any difference between a desired engine idle speed and actual engine idle speed; adjusting the purge flow to maintain the bypass throttle position within a preselected range; detecting when purged fuel vapors are below a predetermined mass per unit of time; and decreasing rate of vapor purge in a preprogramed manner in response to the detection step.

An advantage of the above aspect of the invention, is that vapor purge is gradually turned off in a preprogrammed manner thereby preventing any disturbance to feedback idle speed control.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
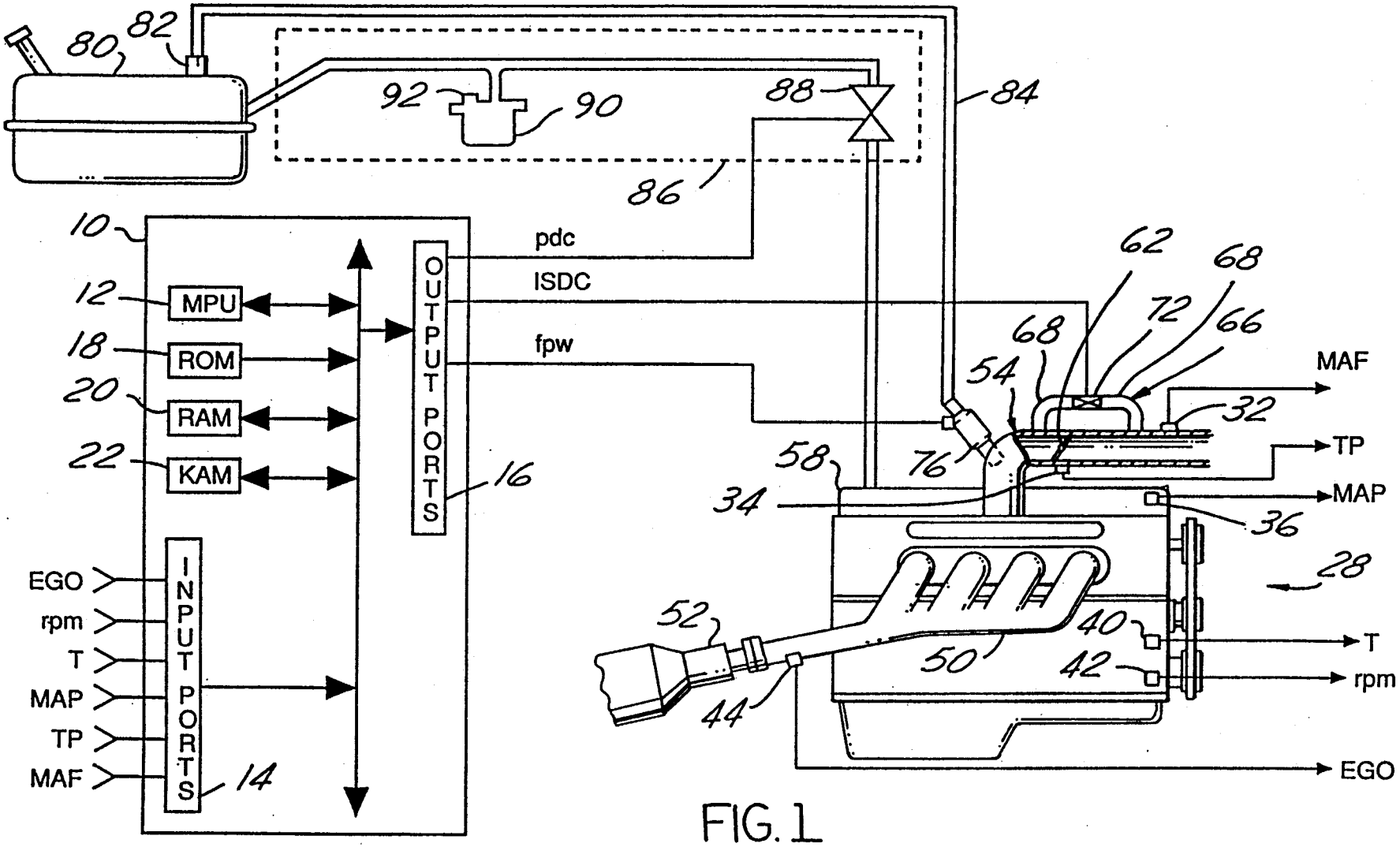
FIG. 1 is a block diagram of an embodiment wherein the invention is used to advantage.

Controller 10 is shown in the block diagram of FIG. 1 as a conventional microcomputer including: microprocessor unit 12; input ports 14; output ports 16; read only memory 18, for storing control programs; random access memory 20, for temporary data storage which may also be used for counters or timers; keep-alive memory 22, for storing learned values; and a conventional data bus. As described in greater detail later herein with particular reference to FIGS. 2–7, controller 10 controls operation of engine 28 by the following control signals: pulse width signal fpw for controlling liquid fuel delivery; purge duty cycle signal pdc for controlling fuel vapor recovery; and idle speed duty cycle signal ISDC for controlling engine idle speed.

Controller 10 is shown receiving various signals from conventional engine sensors coupled to engine 28 including: measurement of inducted mass airflow (MAF) from mass airflow sensor 32; indication of primary throttle position (TP) from throttle position sensor 34; manifold absolute pressure (MAP), commonly used as an indication of engine load, from pressure sensor 36; engine coolant temperature (T) from temperature sensor 40; indication of engine speed (rpm) from tachometer 42; and output signal EGO from exhaust gas oxygen sensor 44 which, in this particular example, provides an indication of whether exhaust gases are either rich or lean of stoichiometric combustion.

In this particular example, engine 28 is shown having EGO sensor 44 coupled to exhaust manifold 50 upstream of conventional catalytic converter 52. Intake manifold 58 of engine 28 is shown coupled to throttle body 54 having primary throttle plate 62 positioned therein. Bypass throttling device 66 is shown coupled to throttle body 54 and includes: bypass conduit 68 connected for bypassing primary throttle plate 62; and solenoid valve 72 for throttling conduit 68 in proportion to the duty cycle of idle speed duty cycle signal ISDC from controller 10. Throttle body 54 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Fuel vapor recovery system 86 is shown including vapor storage canister 90, connected in parallel to fuel tank 80, for absorbing fuel vapors by activated charcoal contained within the canister. Fuel vapor recovery system 86 is shown connected to intake manifold 58 via electronically actuated purge control valve 88. In this particular example, the cross-sectional area of purge control valve 88 is determined by the duty cycle of actuating signal pdc from controller 10.

During fuel vapor recovery, commonly referred to as vapor purge, air is drawn through canister 90 via inlet vent 92 thereby desorbing hydrocarbons from the activated charcoal. The mixture of purged air and recovered fuel vapors is inducted into manifold 58 via purge control valve 88. Concurrently, recovered fuel vapors from fuel tank 80 are drawn into intake manifold 58 through valve 88.

Figure 2:
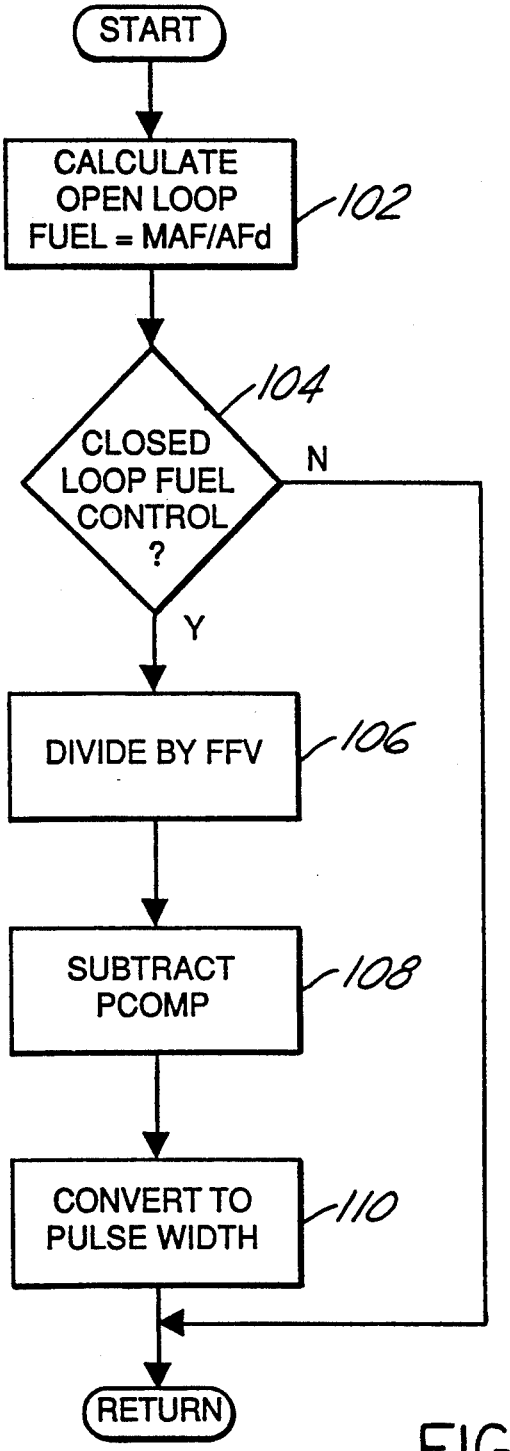
FIGS. 2–7 are high level flowcharts illustrating steps performed by a portion of the embodiment illustrated in FIG. 1.

Referring now to FIG. 2, a flowchart of the liquid fuel delivery routine executed by controller 10 for controlling engine 28 is now described. An open loop calculation of desired liquid fuel is first calculated in step 102. The measurement of inducted mass airflow (MAF) is divided by a desired air fuel ratio (AFd) which, in this particular example, is selected for stoichiometric combustion (14.7 lbs. air per 1 lb. fuel). After a determination is made that closed loop or feedback fuel control is desired (step 104), the open loop fuel calculation is trimmed by fuel feedback variable FFV to generate desired fuel signal Fd during step 106. The operation of controller 10 in generating fuel feedback variable FFV to maintain stoichiometric combustion is described later herein with particular reference to FIG. 3.

Purge compensation signal (PCOMP) is subtracted from desired fuel signal Fd during step 108 to generate modified desired fuel signal Fdm. As described later herein with respect to the routine executed by controller 10 shown in FIG. 4, signal PCOMP represents the mass flow rate of fuel vapors inducted by engine 28 from fuel vapor recovery system 86. After correction by signal PCOMP, the modified desired liquid fuel (Fdm) is converted into fuel pulse width signal fpw for actuating fuel injector 76 (step 110). Accordingly, the liquid fuel delivered by fuel injector 76 is both trimmed by feedback from EGO sensor 44 and reduced in proportion to the mass of fuel vapors inducted per unit of time to maintain stoichiometric combustion.

Figure 3:
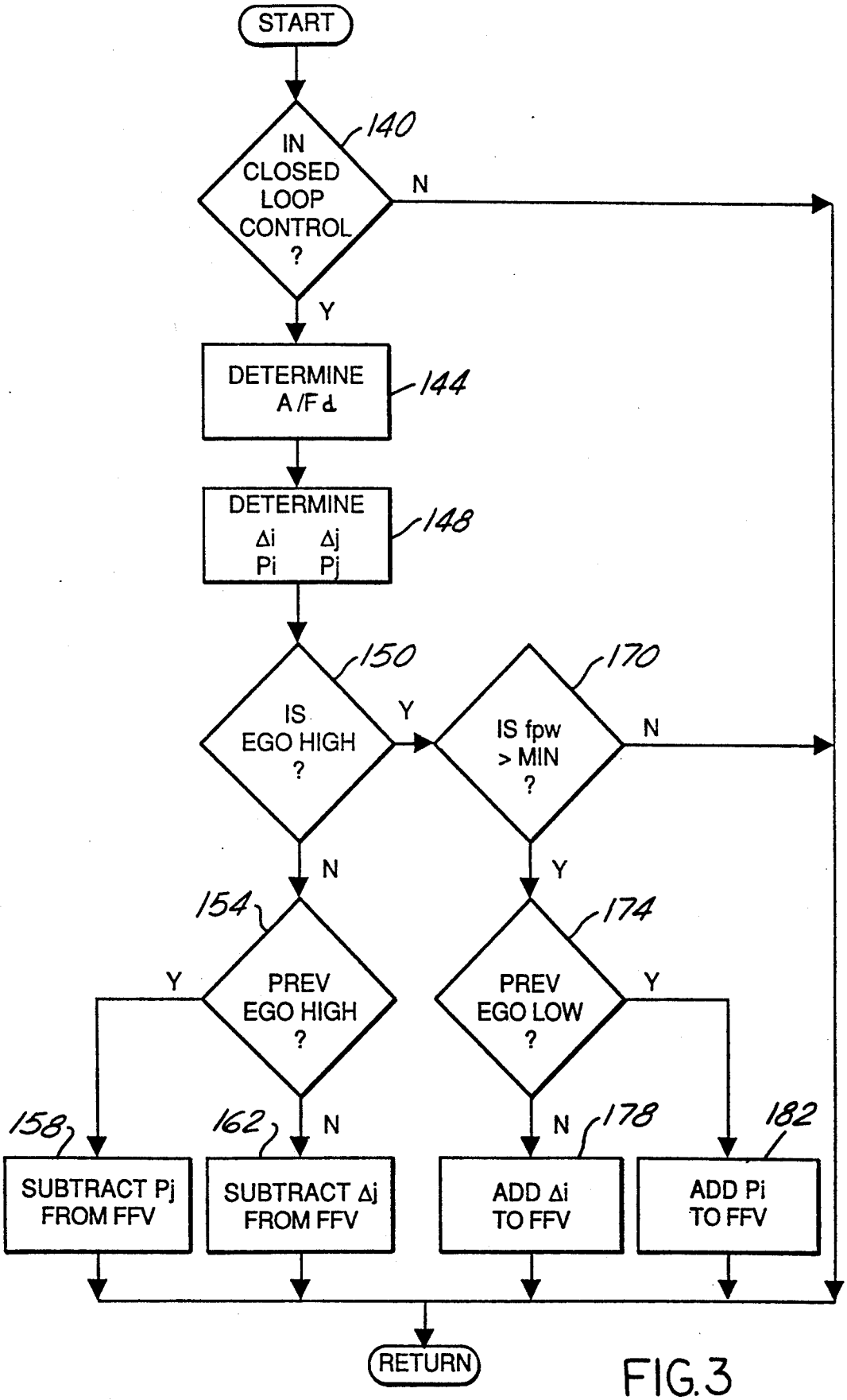

The air/fuel feedback routine executed by controller 10 to generate fuel feedback variable FFV is now described with reference to the flowchart shown in FIG. 3. After a determination is made that closed loop (i.e., feedback) air/fuel control is desired in step 140, the desired air/fuel ratio (AFd) is determined in steP 144. The proportional terms (Pi and Pj) and integral terms ($\Delta i$ and $\Delta j$) of the proportional plus integral feedback control system described below are then determined in step 148. These proportional and integral terms are selected to achieve, on average, air/fuel operation at AFd.

EGO sensor 44 is sampled in step 150 during each background loop of controller 10. When EGO sensor 44 is low (i.e., lean), but was high (i.e., rich) during the previous background loop (step 154), proportional term Pj is subtracted from signal FFV in step 158. When EGO sensor 44 is low, and was also low during the previous background loop, integral term $\Delta j$ is subtracted from signal FFV in step 162. Accordingly, in this particular example of operation, proportional term Pj represents a predetermined rich correction which is applied when EGO sensor 26 switches from rich to lean. Integral term $\Delta j$ represents an integration step to provide continuously increasing rich fuel delivery while EGO sensor 26 continues to indicate combustion lean of stoichiometry.

When EGO sensor 44 is high, but was low during the previous background loop (step 174), proportional term Pi is added to signal FFV in step 182. When EGO sensor 44 is high, and was also high during the previous background loop, integral term $\Delta i$ is added to signal FFV in step 178. Proportional terms Pi represents a proportional correction in a direction to decrease fuel delivery when EGO sensor 44 switches from lean to rich, and integral term $\Delta i$ represents an integration step in a fuel decreasing direction while EGO sensor 44 continues to indicate combustion rich of stoichiometry.

Figure 4:
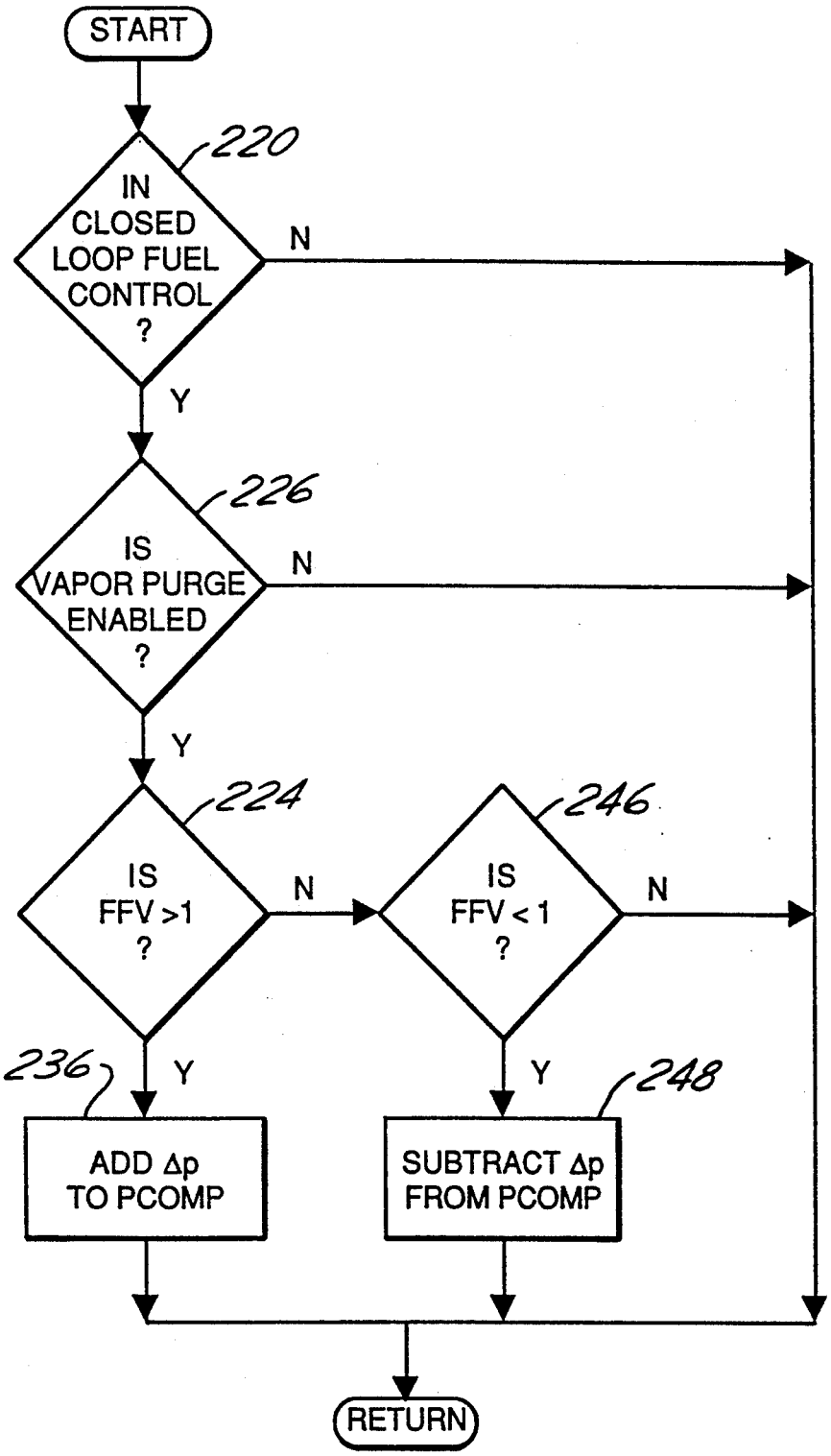

Referring now to FIG. 4, the routine executed by controller 10 to generate purge compensation signal PCOMP is now described. When controller 10 is in closed loop or feedback air/fuel control (step 220), and vapor purge is enabled (step 226), signal FFV is compared to its reference or nominal value, which is unity in this particular example. If signal FFV is greater than unity (step 224), indicating a lean fuel correction is being provided, signal PCOMP is incremented by integration value $\Delta p$ during step 236. The liquid fuel delivered to engine 28 is thereby decreased, or leaned, by $\Delta p$ each sample time when signal FFV is greater than unity. When signal FFV is less than unity (step 246), integral value $\Delta p$ is subtracted from signal PCOMP during step 248. Delivery of liquid fuel is thereby increased and signal FFV is again forced towards unity.

In accordance with the above described operation, the purge compensation routine executed by controller 10 adaptively learns the mass flow rate of recovered fuel vapors. Delivery of liquid fuel is corrected by this learned value (PCOMP) to maintain stoichiometric combustion while fuel vapors are recovered or purged.

Figure 5:
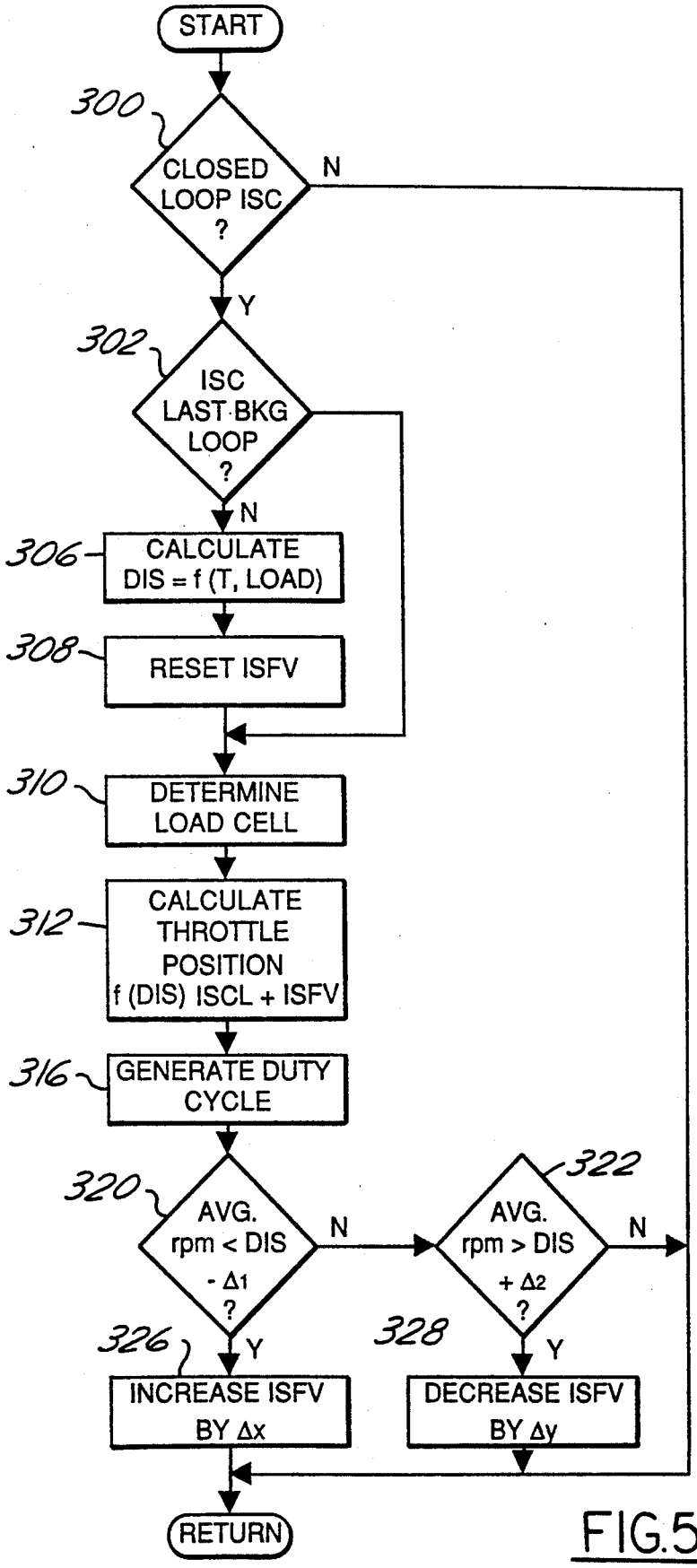

Referring now to FIG. 5, the idle speed feedback control routine performed by controller 10 is now described. Feedback or closed loop idle speed control (ISC) commences when preselected operating conditions are detected (see step 300). Typically such operating conditions are a closed primary throttle position and engine speed less than a preselected value thereby distinguishing closed throttle idling from closed throttle deceleration.

Closed loop idle speed control continues for the time period during which selected engine operating conditions remain at preselected values. At the beginning of each idle speed control period (see step 302), a desired (or reference) idle speed DIS is calculated as a function of engine operating conditions such as engine speed (rpm) and coolant temperature (see step 306). The previous idle speed feedback variable ISFV is also reset to zero (see step 308) at the beginning of each idle speed control period.

After the above described initial conditions are established, the following steps (310–328) are performed each background loop of controller 10. During step 310, the appropriate load operating cell is selected to receive idle speed correction. Controller 10 then calculates desired throttle position for bypass throttling device 66 (step 312). The desired idling speed DIS at the beginning of the idle speed control period is converted into a bypass throttle position, typically by a look-up table, and this initial throttle position is corrected by idle speed learned correction ISLC. In general, signal ISLC is based upon the error between the initial throttle position (derived from DIS) and the actual throttle position which feedback control maintained to operate at the desired idle speed DIS.

During step 312, the corrected throttle position (desired or initial position corrected by signal ISLC) is further corrected by the idle speed feedback variable ISFV, the generation of which is described below. The idle speed duty cycle ISDC for operating solenoid valve 72 of bypass throttling device 66 is then calculated in step 316. This duty cycle moves the bypass throttle to the value calculated in step 312.

Controller 10, in this one example of operation, provides a dead band with hysteresis around desired idle speed DIS in steps 320 and 322. When average engine speed is less than the dead band (DIS minus $\Delta 1$), idle speed feedback variable ISFV is increased by predetermined amount $\Delta x$ in step 326. When average engine speed is greater than the dead band (DIS plus $\Delta 2$), ISFV is decreased by predetermined amount $\Delta y$ in step 328. Accordingly, ISFV will appropriately increase or decrease the bypass throttle position (see step 312) to maintain, on average, desired idle speed DIS.

Figure 6:
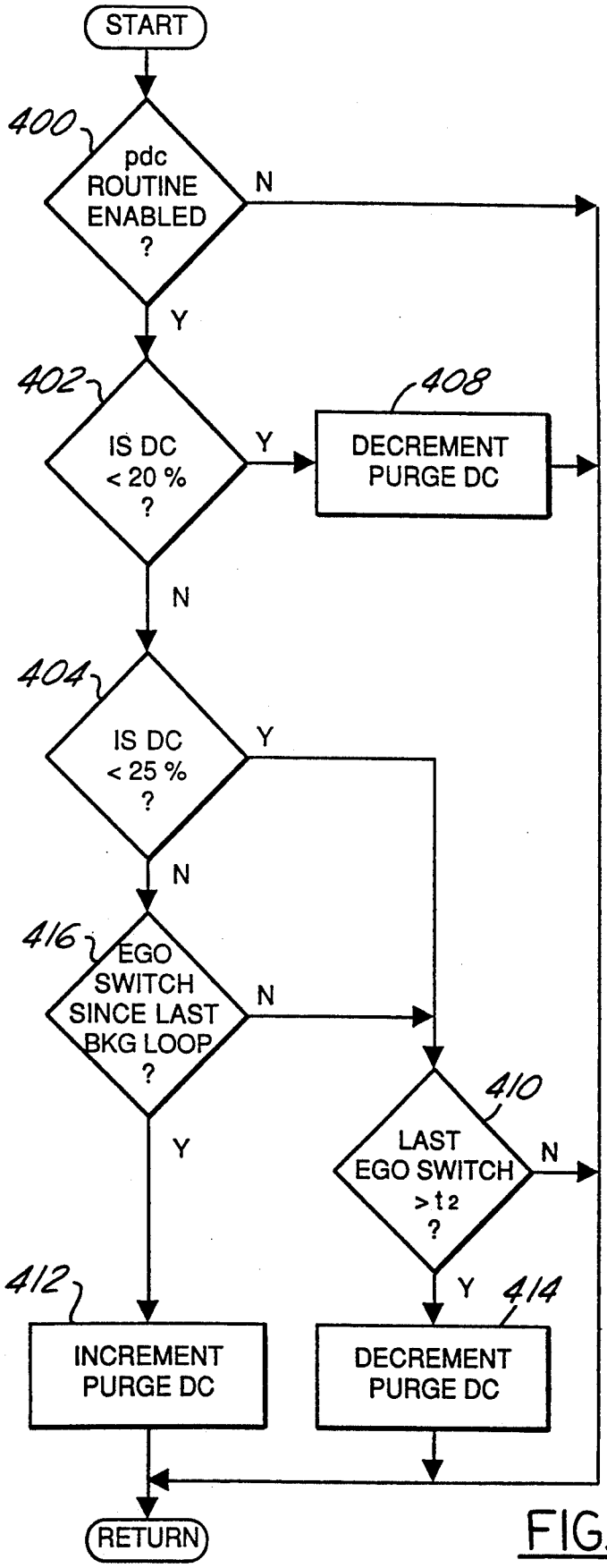

The routine for controlling purge flow during engine idling is now described with reference to FIG. 6. After fuel vapor recovery, or purge, is enabled (step 400), idle speed duty cycle ISDC is compared to a dead band in steps 402 and 404. If ISDC is less than the dead band (selected as 20% duty cycle in this example), the purge flow is decreased a predetermined increment in step 408. More specifically, the duty cycle of purge duty cycle signal pdc from controller 10 is decreased a predetermined percentage thereby decreasing purge flow through purge valve 88.

When idle speed duty cycle ISDC is within the dead band (selected between 20% and 25% in this particular example), purge flow is unaltered provided EGO sensor 44 has switched states during predetermined time t2 (step 410). On the other hand, if EGO sensor 44 has not switched states during time t2, purge flow is decreased a predetermined amount (step 414).

If idle speed duty cycle ISDC is greater than the dead band, increases in purge flow are enabled (steps 404 and 416). More specifically, purge duty cycle pdc is incremented when both idle speed duty cycle ISDC is above the dead band and EGO sensor 44 has changed states since the last background loop of controller 10.

The above operation may also be described with reference to bypass throttle position because idle speed duty cycle ISCDC determines bypass throttle position. For example, 25% idle speed duty cycle is substantially equivalent to 25% of the maximum bypass throttle position.

Figure 7:
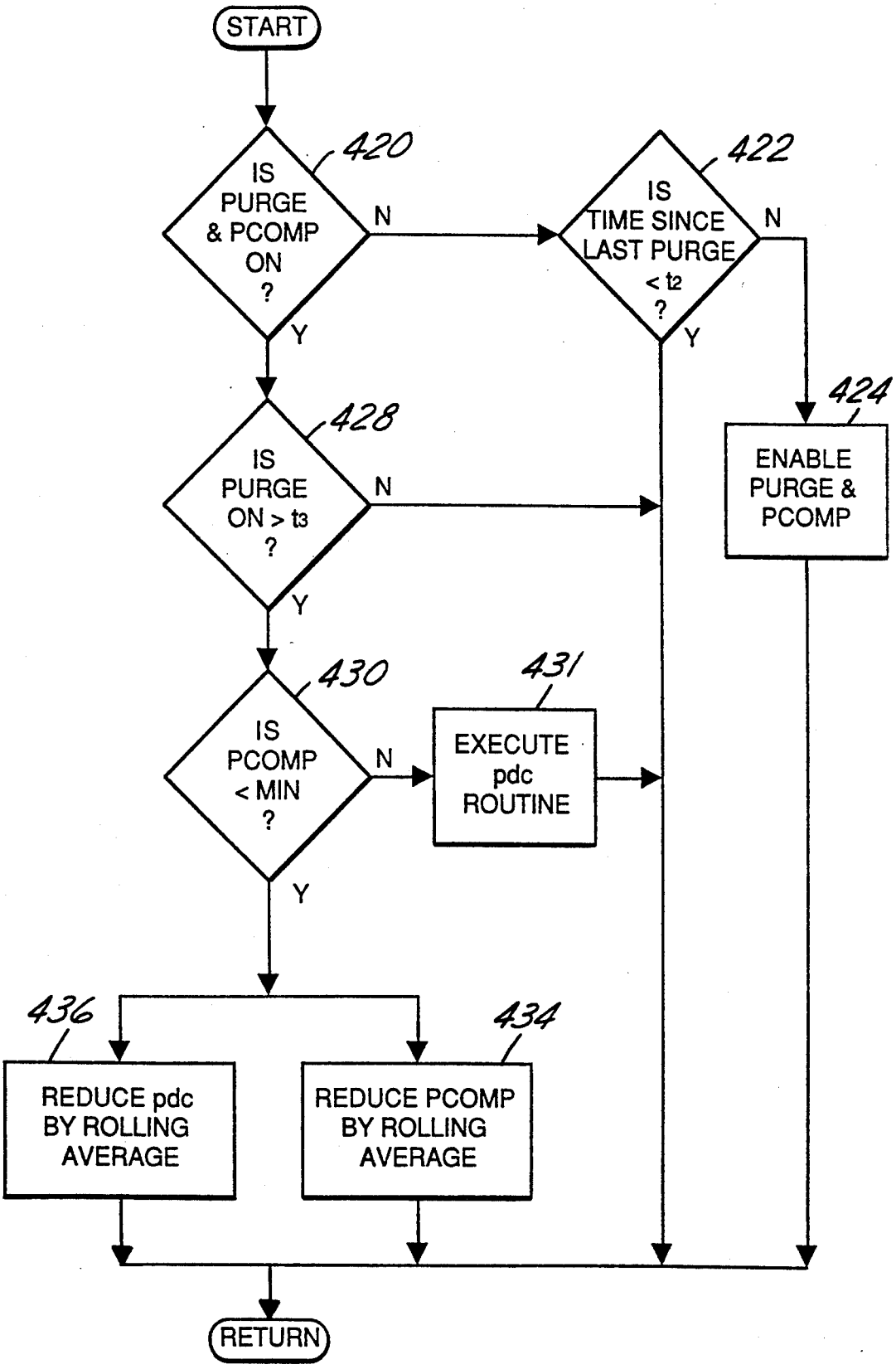

The routine executed by controller 10 for controlling fuel vapor purge is now described with respect to the flowchart shown in FIG. 7. When vapor purge and the purge compensation strategy have been off for more than predetermined time t2 (see steps 420 and 422), fuel vapor purge and the purge compensation strategy are enabled during step 424. On the other hand, if fuel vapor purge and the purge compensation strategy have been activated for greater than predetermined time period t3 (see steps 420 and 428), the value of purge compensation signal PCOMP is compared to a minimum value in step 430. If purge compensation signal PCOMP is less than the minimum valve, which corresponds to negligible presence of fuel vapors, then purge duty cycle signal pdc and purge compensation signal PCOMP are reduced by a rolling average filter as described below.

More specifically, during step 434 a value for signal $PCOMP_i$ during the presently executed routine of controller 10 is calculated based upon signal $PCOMP_{i-1}$ during the previous background loop of controller 10 as shown by the following equation:

$$PCOMP_i = \left(1 - \frac{1}{TC/ti}\right) * PCOMP_{i-1}$$

where TC is a preselected time constant and ti is the time interval between updates of signal PCOMP.

In a similar manner, purge duty cycle signal pdc is calculated in step 436 in accordance with the following equation:

$$pdc_i = \left(1 - \frac{1}{TC/ti}\right) * pdc_{i-1}$$

In accordance with the above described operation, both signal PCOMP and purge duty cycle pdc are decreased by rolling average calculation, or filtering, when the mass of fuel vapors falls below a minimum value (step 430). However, when the mass of inducted fuel vapors is above the minimum value (step 432), the purge duty cycle routine shown in FIG. 6 is executed. Thus, purge flow is maximized during engine idle. And, when purge is disabled it is disabled in a gradual manner thereby permitting idle speed feedback control without abrupt perturbations.

Although one example of an embodiment which practices the invention has been described herein, there are numerous other examples which could also be described. For example, analog devices, or discrete IC's may be used to advantage rather than a microcomputer. The invention is therefore to be defined only in accordance with the following claims.

What is claimed is:

1. A method for controlling idling speed of an engine by controlling a bypass throttle connected in parallel to a primary engine throttle and also controlling purge flow through a vapor recovery system into an air/fuel intake of the engine, comprising the steps of:

positioning the bypass throttle to decrease any difference between a desired engine idle speed and actual engine idle speed;

adjusting the purge flow to maintain said bypass throttle position within a preselected range; predetermined mass per unit of time; and decreasing rate of vapor purge in a preprogramed manner in response to said detection step.

2. The method recited in claim 1 wherein said step of decreasing the purge flow comprises rolling average filtering.

3. The method recited in claim 1 wherein said step of decreasing the purge flow comprises reducing the purge flow after said detection step by a predetermined fraction of the purge flow before said detection step.

4. The method recited in claim 1 further comprising a step of increasing the purge flow when said bypass throttle position is greater than a predetermined portion of a maximum bypass throttle position.

5. A method for controlling idling speed of an engine by controlling a bypass throttle connected in parallel to a primary engine throttle and also controlling purge flow of a mixture of purged air and fuel vapors from a vapor recovery system into an air/fuel intake of the engine, comprising the steps of:

positioning the bypass throttle to decrease any difference between a desired engine idle speed and actual engine idle speed;

increasing the purge flow until said positioning step maintains the bypass throttle within a preselected position range;

adjusting liquid fuel inducted into the air/fuel intake in response to a compensation value related to mass of the fuel vapors purged into the air/fuel intake per unit of time;

detecting when the purged fuel vapors are below a predetermined mass per unit of time;

decreasing purge flow in a preprogramed manner in response to said detection step; and decreasing said compensation value in a preprogramed manner in response to said detection step.

6. The method recited in claim 5 wherein said step of decreasing the purge flow comprises reducing the purge flow after said detection step by a predetermined fraction of the purge flow before said detection step.

7. The method recited in claim 5 wherein said adjusting step provides said compensation value by integrating a difference between a feedback variable and a reference corresponding to stoichiometric combustion of exhaust gases, said feedback variable being derived by integrating an output of an exhaust gas oxygen sensor.

8. A control system for controlling idling speed of an engine, comprising:

a bypass throttle connected in parallel to a primary engine throttle;

idle speed control means for positioning said bypass throttle to decrease any difference between a desired engine idle speed and actual engine idle speed;

a vapor recovery system including a purge control means for controlling purge flow of a mixture of purged air and fuel vapors from said vapor recovery system into an air/fuel intake of the engine, said purge control means decreasing said purge flow when said bypass throttle position is less than a preselected fraction of a maximum bypass throttle position and increasing said purge flow when said bypass throttle position is greater than a predetermined fraction of said maximum bypass throttle position;

detection means for detecting when said purged fuel vapors are below a predetermined mass per unit of time; and said purge control means decreasing purge flow by predetermined steps in response to each of said detections of said purged fuel vapors being less than said predetermined mass.

9. The control system recited in claim 8 wherein said detection means provides said detection by integrating a difference between a feedback variable and a reference corresponding to stoichiometric combustion of exhaust gases, said feedback variable being derived by integrating an output of an exhaust gas oxygen sensor.

10. The control system recited in claim 9 wherein said purge control means increases said purge flow in response to said detection means detecting when said purged fuel vapors are greater than said predetermined mass per unit of time.

* * * * *

UNITED STATES PATENT AND TRADEMARK OFFICE

CERTIFICATE OF CORRECTION

PATENT NO. : 5,203,300

DATED : April 29, 1993

INVENTOR(S) : Daniel V. Orzel

It is certified that error appears in the above-identified patent and that said Letters Patent is hereby corrected as shown below:

Correct Claim 1 as follows:
At line 22 add --detecting when purged fuel vapors are below a-- before the word "predetermined".

Signed and Sealed this

Eighth Day of March, 1994

Bruce Lehman

*Attest:*

BRUCE LEHMAN

*Attesting Officer*

*Commissioner of Patents and Trademarks*